United States Patent [19]

Krebs

[11] Patent Number: 4,856,659

[45] Date of Patent: Aug. 15, 1989

[54] INTERLOCKING SUPPORT SYSTEM

[76] Inventor: Jimmy M. Krebs, 33 E. Palatine Rd., Prospect Heights, Ill. 60070

[21] Appl. No.: 257,886

[22] Filed: Oct. 14, 1988

[51] Int. Cl.[4] ..... A47F 7/04

[52] U.S. Cl. ..... 211/24; 211/23; 211/43

[58] Field of Search ..... 211/24, 23, 43, 42, 211/175, 184, 60.1, 49.1; 206/304, 303; 40/587

[56] References Cited

U.S. PATENT DOCUMENTS 1,750,575 3/1930 Cubberley ..... 211/43 X 1,750,576 3/1930 Cubberley ..... 211/43 X 2,051,448 8/1936 Johnson ..... 211/43

4,496,127 1/1985 Nelson ..... 211/43 X

*Primary Examiner*—Blair M. Johnson

*Attorney, Agent, or Firm*—Douglas B. White

[57] ABSTRACT

There is provided a display apparatus for automobile tires molded as a one piece structure and assembled from two identical members. The tire supporting surface is located on the surface of the legs of each structure. This surface has indentations which protrude on the underside of the surface whereby overlapping legs interlock under the weight of the tire to create a rigid structure supporting the tire in a vertical position.

5 Claims, 2 Drawing Sheets

INTERLOCKING SUPPORT SYSTEM

BACKGROUND OF THE INVENTION

1. Field of the Invention

This invention relates generally to display apparatus and more particularly to support apparatus consisting of identical plastic molded members which interlock under the weight of the supported object to produce an upright display.

2. Description of Prior Art

Prior devices have included stands with end members having a hinged support therebetween, whereby the end members engage the tire at the hinge. (U.S. Pat. No. 1,569,737 granted to Fording, 1926). A similar device comprises end members having lower supporting arcuate leg portions, whereby pressure from the tire on the arcuate legs rotates the end portions into engagement with the tire. (U.S. Pat. No. 1,665,887 granted to Lind, 1923). A third such device comprises a pair of support members adapted to support files in a vertical position, having engagement means for slideably engaging a tongue portion of one member and a slot of the second member. (U.S. Pat. No. 3,844,415 granted to Heimann, 1974). These prior devices are generally characterized as elaborate and too complicated for economical production and require manufacture of multiple components. Further, these devices have limited lateral adjustment capability. For example, the Heimann reference requires an inward tilt of the end support members before a lateral adjustment can be made.

SUMMARY OF THE INVENTION

The present invention, by contrast, comprises identical left and right support members adapted to interlock. These include upright members having extending horizontal legs for supporting the tire. The upper surface on the legs exhibits indentations which protrude on the underside whereby overlapping legs will position the protrusions into the indentations. Thereby weight placed on the stand causes the legs to interlock and creates a rigid structure supporting the tire or other product.

BRIEF DESCRIPTION OF THE DRAWINGS

For a more complete understanding of this invention, reference should now be made to the accompanying drawings and described below by way of example of the invention.

While the invention will be described in connection with a preferred embodiment, it will be understood that I do not intend to limit the invention to that embodiment. On the contrary, I intend to cover all alternatives, modifications, and equivalents as may be included within the spirit and scope of the invention as defined by the appended claims.

DESCRIPTION OF THE PREFERRED EMBODIMENT

Figure 1:
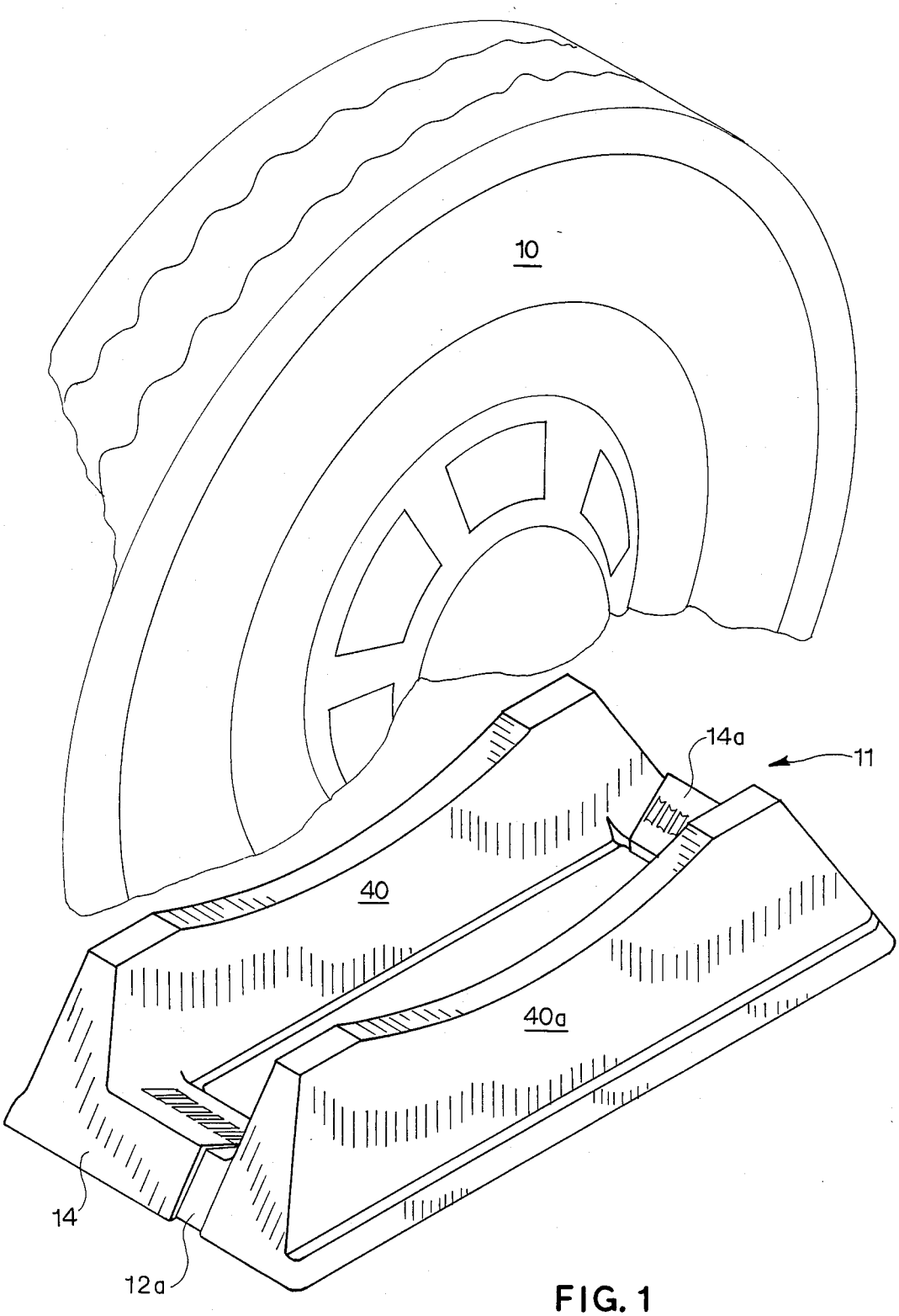
FIG. 1 is a prespective view of the support apparatus of the present invention showing identical left and right interlocked support members positioned to accept and support a vehicle tire therebetween.
Figure 2:
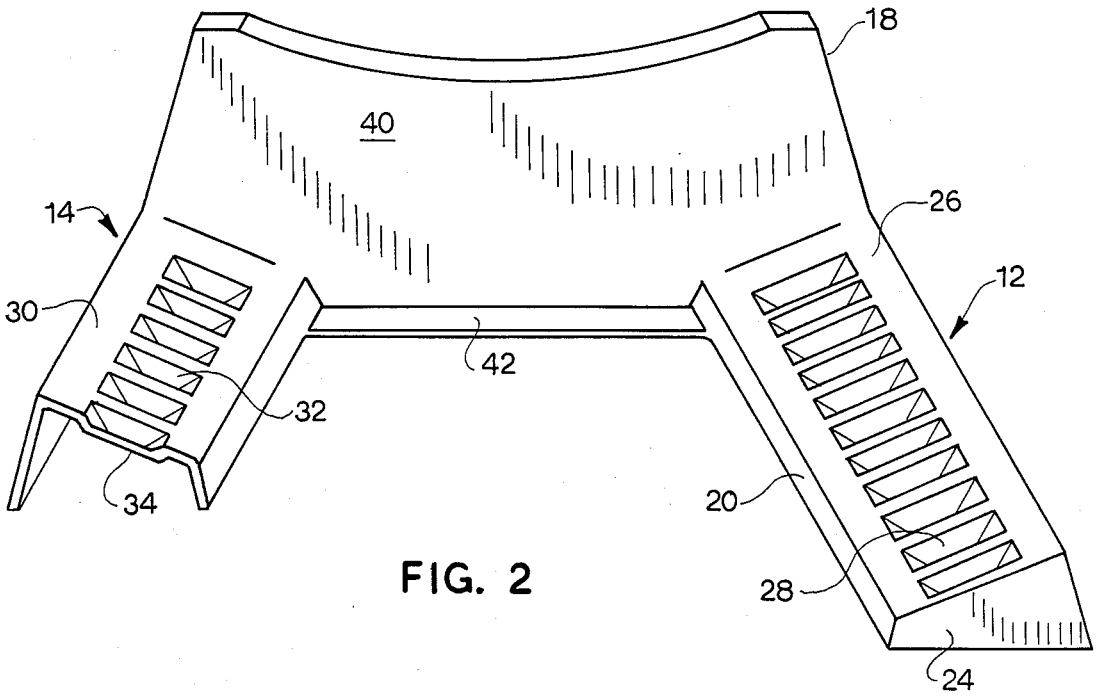
FIG. 2 is a perspective view of one of said support members showing the extending horizontal legs.

Turning first to FIG. 1, an automobile tire 10 is shown held upright by the support apparatus 11 of the present invention. In the preferred embodiment this support apparatus is comprised of two identical interlocking members preferably of a one piece plastic molded product and is shown most clearly in FIG. 2.

The support member (shown most clearly in FIG. 2), comprises horizontally extending legs 12 and 14 protruding from one side of a vertically extending upright member 18. The first of said legs (12) comprises a box like member of trapezoidal cross section having side members 20. In one embodiment these sides are angled outwardly to further improve structural support. To provide further structural support in addition to the side members an end wall 24 is provided on the extremity of the leg.

For underlying the tire 10 there is provided a contact surface 26 angled downwardly toward the center of the structure to accommodate the curvature of the tire and mounted to the side members 20 and the end wall 24. Defined on this contact surface are corrugations or indentations 28 arranged to interlock with mating protrusions from the extending leg of the opposing support member.

The second of said legs (14) is shortened to allow for close positioning of the support members. This leg is similarly of trapezoidal construction but is slightly wider than the first of said legs. No end wall is provided on this leg inasmuch as it must envelop the longer leg when the apparatus is assembled. Arranged along the contact surface 30 of this leg are similar corrugations or indentations 32 producing protrusions 34 on the underside of the surface. When this shorter leg is placed and aligned over the longer leg of the opposing support member, the protrusions 34 mate into the indentations 28 of the longer leg.

An upright wall 40 is rigidly affixed to the horizontal legs and arranged to abut the supported tire and maintain it in an upright position. This member is typically of a hollow plastic design, molded with the leg members. Additionally, in the preferred embodiment, there is provided a transverse bar 42 affixed to and tying the legs and the upright wall to provide increased rigidity and support. As a result, this design allows the plastic molding of the entire structure as a single piece which is then usable for each of the opposing sides of the support apparatus.

Figure 3:
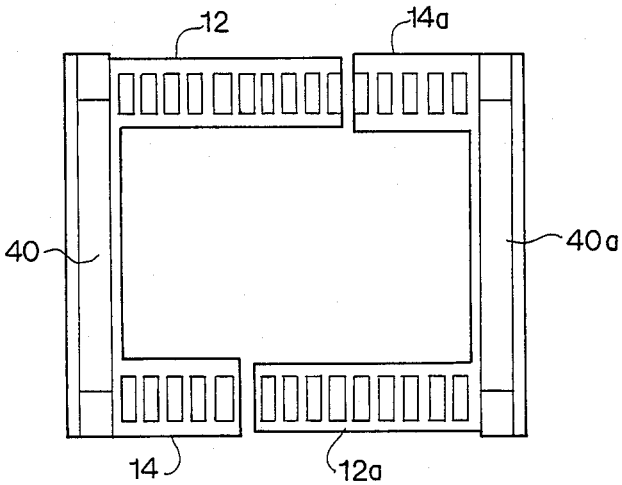
FIG. 3 is a plan view of the support members of FIG. 1, disengaged and aligned proximate one another.

Assembly of the support members is begun as shown in FIG. 3. With the support members arranged facing each other in opposing relation, the shorter legs 14 and **14*a* are placed over the narrower opposing longer legs 12*a* and 12, respectively, and positioned to interlock the corresponding protrusions and indentations. Once the legs are interlocked, the tire or similar object to be displayed may be placed on the leg members between the uprights 40 and 40*a***, and thereby be held upright for display. As a result, the weight of the tire holds the device in interlocked relation and ensures its own support. Lateral adjustment is accomplished by lifting the displayed object and shifting the support members to align corrugations at different positions.

From the foregoing description, it will be apparent that modifications can be made to the apparatus and method for using same without departing from the teaching of the present invention. Accordingly the scope of the invention is only to be limited as necessitated by the accompanying claims.

I claim:

1. An improved support apparatus for vehicle tires comprising:

first and second support members, wherein each support member comprises a first and second horizontally extending leg and an upright portion affixed thereto, and wherein each leg comprises opposing side surfaces and a top surface transverse to said side surfaces, said top surface having a corrugated portion defined thereon, whereby said legs from said first and second support members are overlappingly engaged so that said corrugated portions interlock and to provide a free standing structure having a gap between said first and second legs to accommodate the vehicle tire.

2. The improved support apparatus for vehicle tires of claim 1 wherein said top surfaces of said legs are inclined downwardly toward the center of said support member.

3. The improved support apparatus for vehicle tires of claim 2 wherein said first leg member further comprises a transverse end surface.

4. The improved support apparatus for vehicle tires of claim 2 wherein said first leg member is longer than the second of said legs.

5. The improved support apparatus for vehicle tires of claim 1 further comprising a bar portion affixed to said upright portion and to said members.

* * * * *